US009349309B1

(12) United States Patent
Eloyan et al.

(10) Patent No.: US 9,349,309 B1
(45) Date of Patent: May 24, 2016

(54) VEHICLE EXTERNAL WARNING APPARATUS

(71) Applicants: Ashot Eloyan, Pasadena, CA (US); Edvin Tsaturyan, Glendale, CA (US)

(72) Inventors: Ashot Eloyan, Pasadena, CA (US); Edvin Tsaturyan, Glendale, CA (US)

( * ) Notice: Subject to any disclaimer, the term of this patent is extended or adjusted under 35 U.S.C. 154(b) by 0 days.

(21) Appl. No.: 13/999,701

(22) Filed: Mar. 18, 2014

(51) Int. Cl.
*G09F 21/04* (2006.01)
*G09F 13/04* (2006.01)
*G09F 13/06* (2006.01)

(52) U.S. Cl.
CPC ..... *G09F 21/048* (2013.01); *G09F 13/0413* (2013.01); *G09F 13/06* (2013.01); *G09F 2013/044* (2013.01)

(58) Field of Classification Search
CPC ..... G09F 13/0404; G09F 2013/044; G09F 13/08; G09F 21/04; G09F 13/0413; G09F 21/048
USPC ..... 40/579, 592, 556
See application file for complete search history.

(56) References Cited

U.S. PATENT DOCUMENTS

| | | | | |
|---|---|---|---|---|
| 1,464,515 | A * | 8/1923 | Thomas | 40/205 |
| 1,761,868 | A * | 6/1930 | Burke | 40/580 |
| 2,851,674 | A | 9/1958 | Boone | |
| 4,297,675 | A | 10/1981 | Rubottom et al. | |
| 4,622,494 | A | 11/1986 | Johnson | |
| 5,426,414 | A | 6/1995 | Flatin et al. | |
| 5,604,480 | A * | 2/1997 | Lamparter | 362/478 |
| 5,900,812 | A | 5/1999 | Ruminski et al. | |
| 6,173,539 | B1 * | 1/2001 | Barnes | 52/103 |
| 6,865,835 | B1 | 3/2005 | Webster | |
| 7,681,347 | B1 * | 3/2010 | Welker et al. | 40/546 |
| 7,791,464 | B1 | 9/2010 | Giddings et al. | |
| 7,834,752 | B2 * | 11/2010 | Kuvantrarai | 340/479 |
| 2007/0240346 | A1 * | 10/2007 | Li et al. | 40/544 |
| 2013/0335948 | A1 * | 12/2013 | Chadwell et al. | 362/97.4 |

* cited by examiner

*Primary Examiner* — Kristina Junge

(57) ABSTRACT

Apparatus to communicate a message to a vehicle exterior, comprising sheet metal box having vertical sides, cut-outs in one of the sides configured to communicate a message, colored translucent plastic material closely covering the cut-outs at the box interior, light means for substantially uniformly illuminating the plastic material, within the box, means to connect the box to the vehicle whereby the cut-outs face rearwardly of the vehicle.

16 Claims, 6 Drawing Sheets

FIG. 1
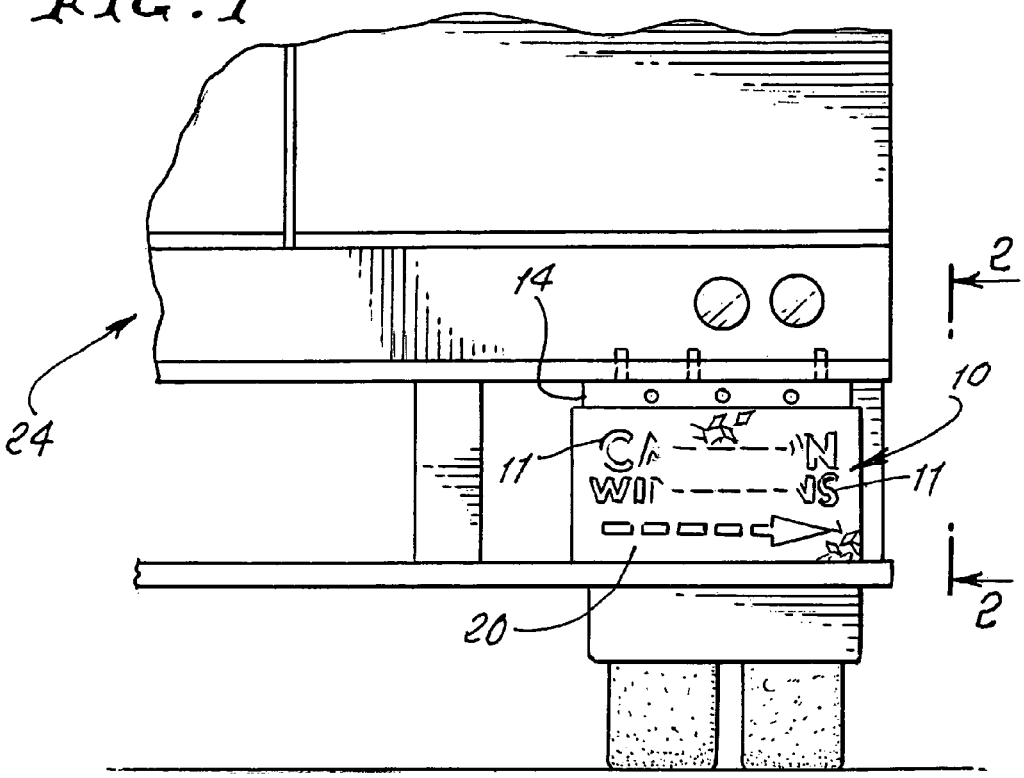
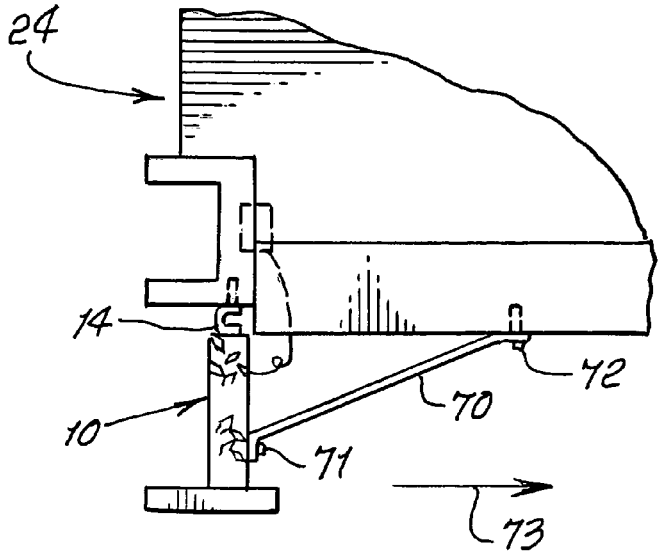
FIG. 2

VEHICLE EXTERNAL WARNING APPARATUS

BACKGROUND OF THE INVENTION

This invention relates generally to safety equipment for vehicles, and more particularly to warning apparatus attachable to the rear of a vehicle to prevent accidents.

There is continuing need for simple, inexpensive, rugged, easily attachable apparatus useful to warn rearward approaching vehicles of possibly dangerous conditions associated with a front vehicle. In particular, there is need to provide a way to communicate a message to the driver of a rear vehicle, following a forward vehicle, in a simple, safe, highly effective and safe manner, using inexpensive apparatus.

SUMMARY OF THE INVENTION

It is a major object of the invention to provide improved apparatus satisfying the above need. Basically, the apparatus comprises:

a) a sheet metal box having vertical sides, b) cut-outs in one of said sides configured to communicate a message, c) colored translucent plastic material closely covering said cut-outs at the box interior, d) light means for substantially uniformly illuminating said plastic material, within the box, e) means to connect said box to the vehicle whereby said cut-outs face rearwardly of the vehicle.

As will be seen, the light means is configured to be carried at a box interior edge portion to illuminate the entire interior of the box at the same intensity level whereby cut-out illumination is uniform; and typically has elongated flat panel configuration and oriented to direct light parallel to said plastic material in flat sheet form.

It is another object to provide for rugged, shake-proof construction of the metal light box, wherein the translucent plastic material protrudes through cut-outs; and in this regard the plastic translucent material is solid, protective, and sealed to cut-out edges to protect the illuminating interior of the light box. The material typically protrudes through cut-outs to provide for rugged gripping of cut-out edges, the box thereby being unitary, and essentially non-destructive, and weatherproof under regular driving condition. Control means is also provided to control the light means to flash upon a right-turn of the vehicle. An electric power line typically extends from the box exterior to the box interior, via an opening in the box, to supply electrical current supply to said light means.

In addition, intended use is for semi tractor trucks/18 Wheelers for caution measures and as a permanent installation on any large truck. It is to be displayed on passenger back end of vehicles trailer and to be connected to and operated in conjunction with vehicles turn signal. An adjustable support arm may be employed as will be shown. The "caution" wide turn visibility signage is made of reflector type of plastic, and the inner portion of box (non visible) plastic box is advantageously made of aluminum 16 gage metal, diamond indented plate, for strength.

Also, all six sided box walls have light reflective metallic inner sides to enhance even light distribution intensity facing the entirety of the plastic translucent material adjacent the cut-outs.

Light transmitted to plastic material near the cut-outs flows to the cut-outs to enhance glow at the cut-outs, and light level within the box interior is enhanced by light travel from the plastic material to the box interior.

These and other objects and advantages of the invention, as well as the details of an illustrative embodiment, will be more fully understood from the following specification and drawings, in which:

DRAWING DESCRIPTION

FIG. 1 is a rear elevation showing light box installation at the right rear of a truck;

FIG. 2 is an enlarged elevation take on lies 2-2 of FIG. 1;

FIG. 6 is a perspective view of the light box;

DETAILED DESCRIPTION

Figures 3, 4:
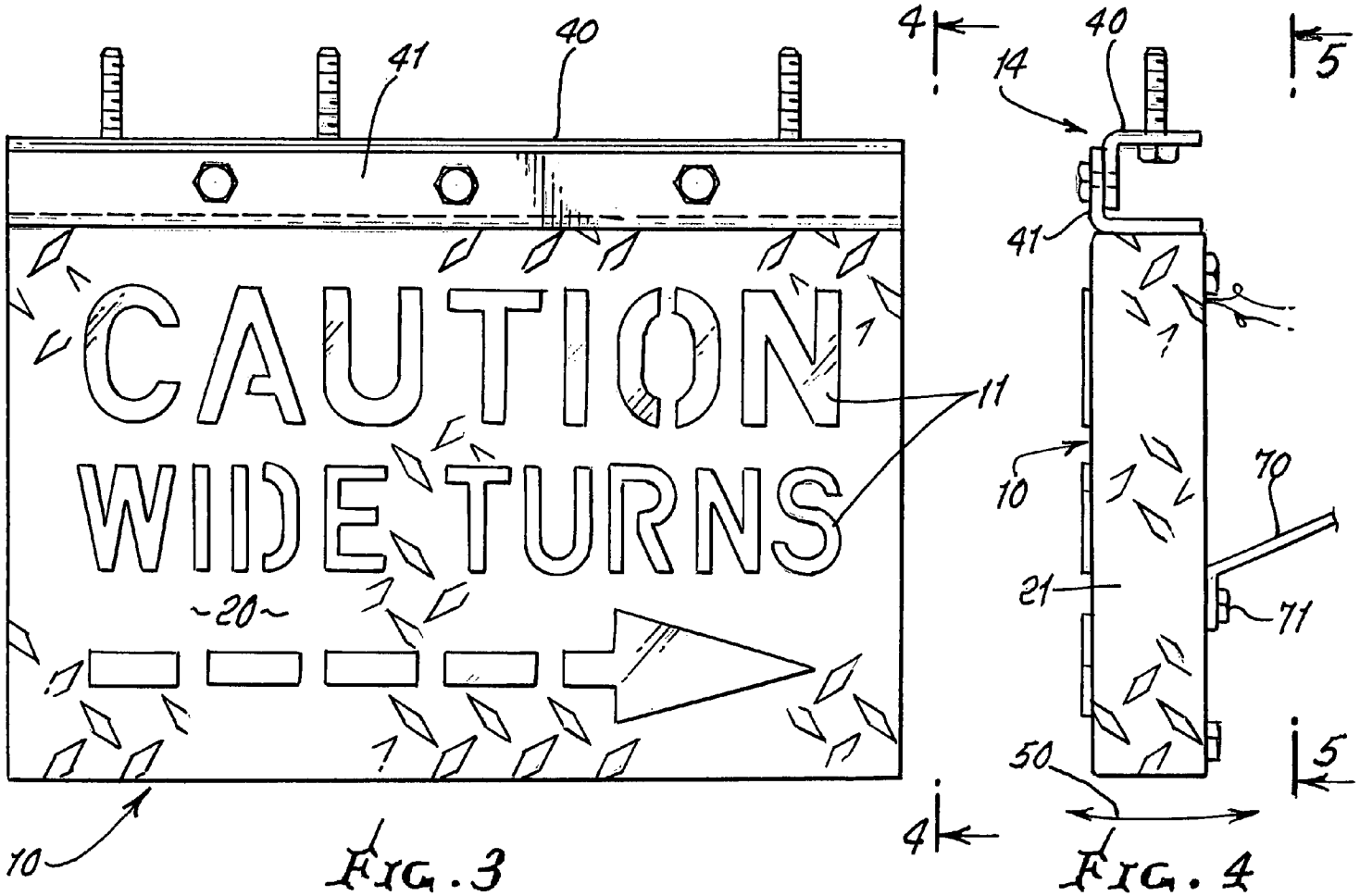
FIG. 3 is an enlarged frontal view of the light box, showing metal panel reinforcement in relation to cut-out positioning.
FIG. 4 is an edge view taken on lines 4-4 of FIG. 3.

Referring to the drawings, they show an example of the following:

10—a sheet metal box having vertical sides,

11—cut-outs in one of said sides configured to communicate a message,

12—colored transport plastic material closely covering said cut-outs at the box interior,

13—light means for substantially uniformly illuminating said plastic material, within the box,

14—means to connect said box to the vehicle whereby said cut-outs face rearwardly of the vehicle.

As shown in the drawings, the box, preferably made of aluminum sheet, has an outside frame 10*a* that includes rearward facing panel 20, with end walls 21 and top and bottom walls 22. Cut-outs 11 in panel 20 face rearwardly to pass light rearwardly from within the box.

Colored translucent plastic material 12 in sheet form, extends at the box interior, and over and into the cut-outs to convey a warning message to a driver rearward of the vehicle such as truck 24 carrying the box at its rear, as seen in FIGS. 1 and 2. Material 12 typically forms a plastic sub-frame that fits tightly i.e. nests within the outside box frame for protection against loosening and damage in the event frame 10*a* is deformed by impact.

Accordingly, light that fills the plastic inside frame continues to travel through the panel 12*a*, and the cut-outs in box panel 20, enhancing safety, by rearward warning.

Elongated light elements 123 are lengthwise adhered to the inside surfaces 26*a* of plastic frame end walls 25, so as not to become dislodged by box impact, thereby providing continuity of light transmission to and through the cut-outs. Damage to and deformation of both panels 20 and 12*a* accordingly does not result in interruption of light transmission to and through the cut-outs. Sideward attachment of light elements 13 to rearward extending end walls 25 provides maximum semi-rigid structural resistance to damage to the light elements, considering that damaging force is channeled parallel to the walls 25. See arrow F. Coining of the outside metal frame and its end walls enhances this protective feature.

Figure 6:
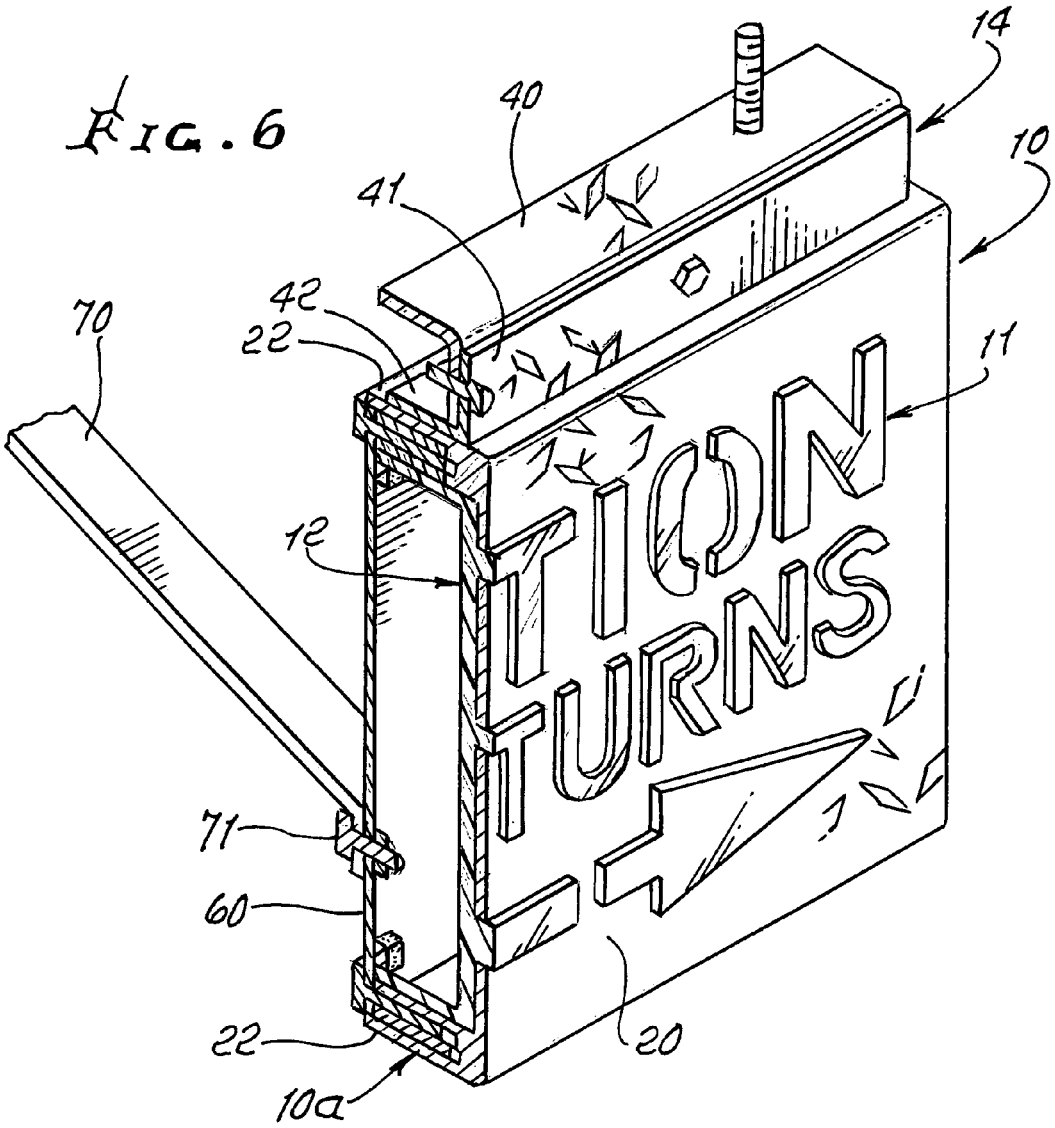
FIG. 6 is a rear elevation taken on lines 5-5 of FIG. 4, and showing box mounting structure.
Figure 7:
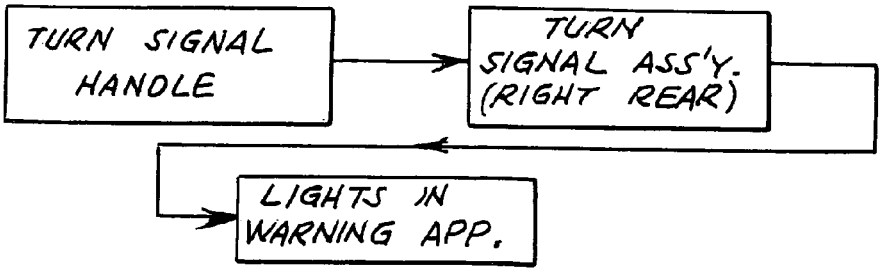
FIG. 7 is a control diagram.

Frame 12 is typically adhesively attached to frame 10*a* at the panels and end walls that closely fit together. See FIGS. 6 and 8.

Figure 8:
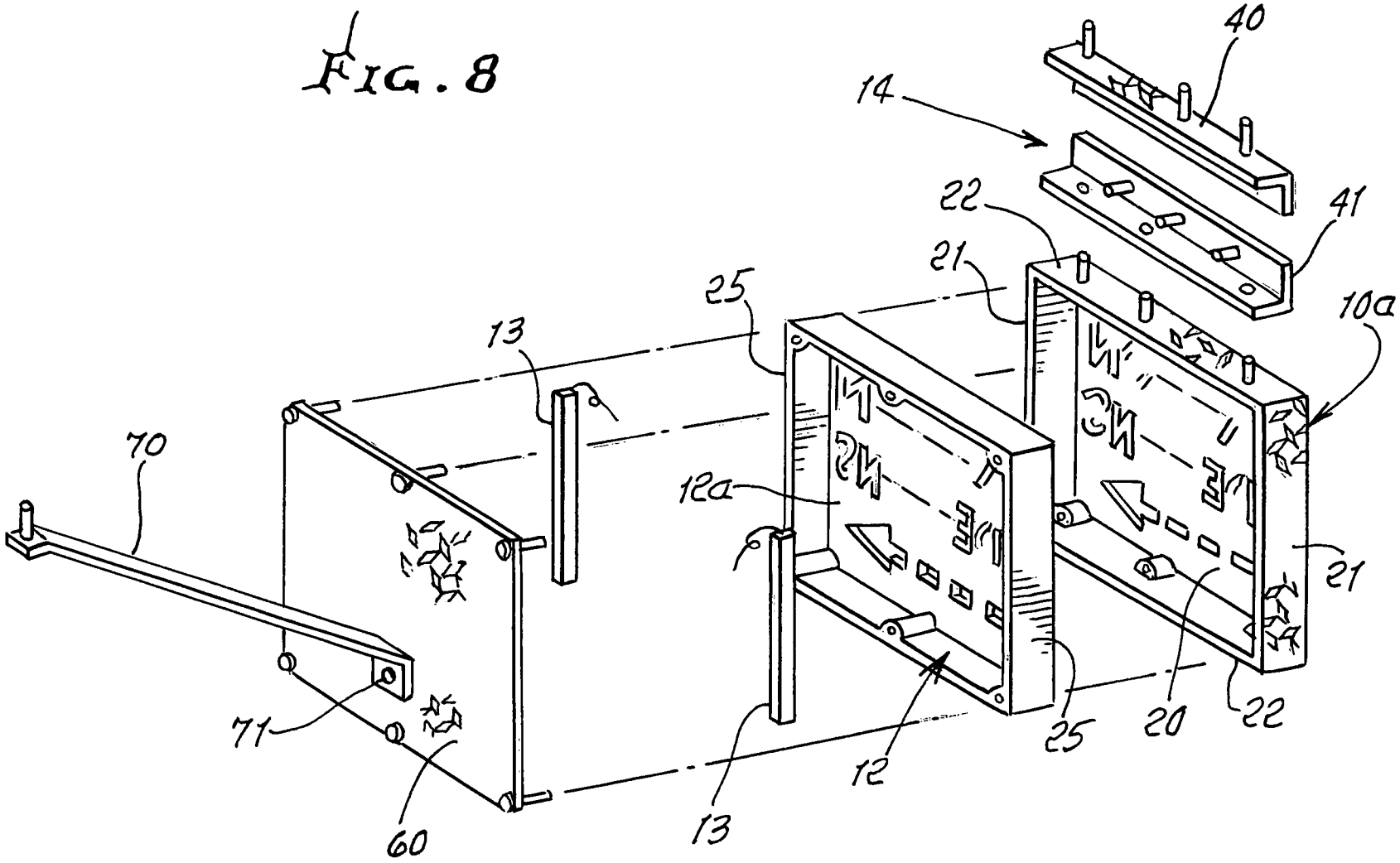
FIG. 8 is an exploded view of the light box, showing component relationships.

FIG. 8 shows L-shaped metal brackets 40 and 41 for mounting the box to the rear surface of the vehicle. Such brackets are typically located above the box outside frame upper side wall 42, for maximum protection of the box and such brackets. This also allows the box to swing or deflect in a curved path indicated by arrow 50, avoiding detachment from the carrier vehicle. A back plate metal cover for the box, and frames, is shown at 60. It has attachment pins 61 peripherally connectable to and to cover both outer and inner frames.

An elongated safety bar 70 is connected to the box lower rear, as 71, and to the vehicle frame at 72, to resist box deflection in direction 73.

The box metal preferably consists of aluminum diamond plate. The plastic is preferably an acrylic reflector material, amber or yellow or red.

Figure 5:
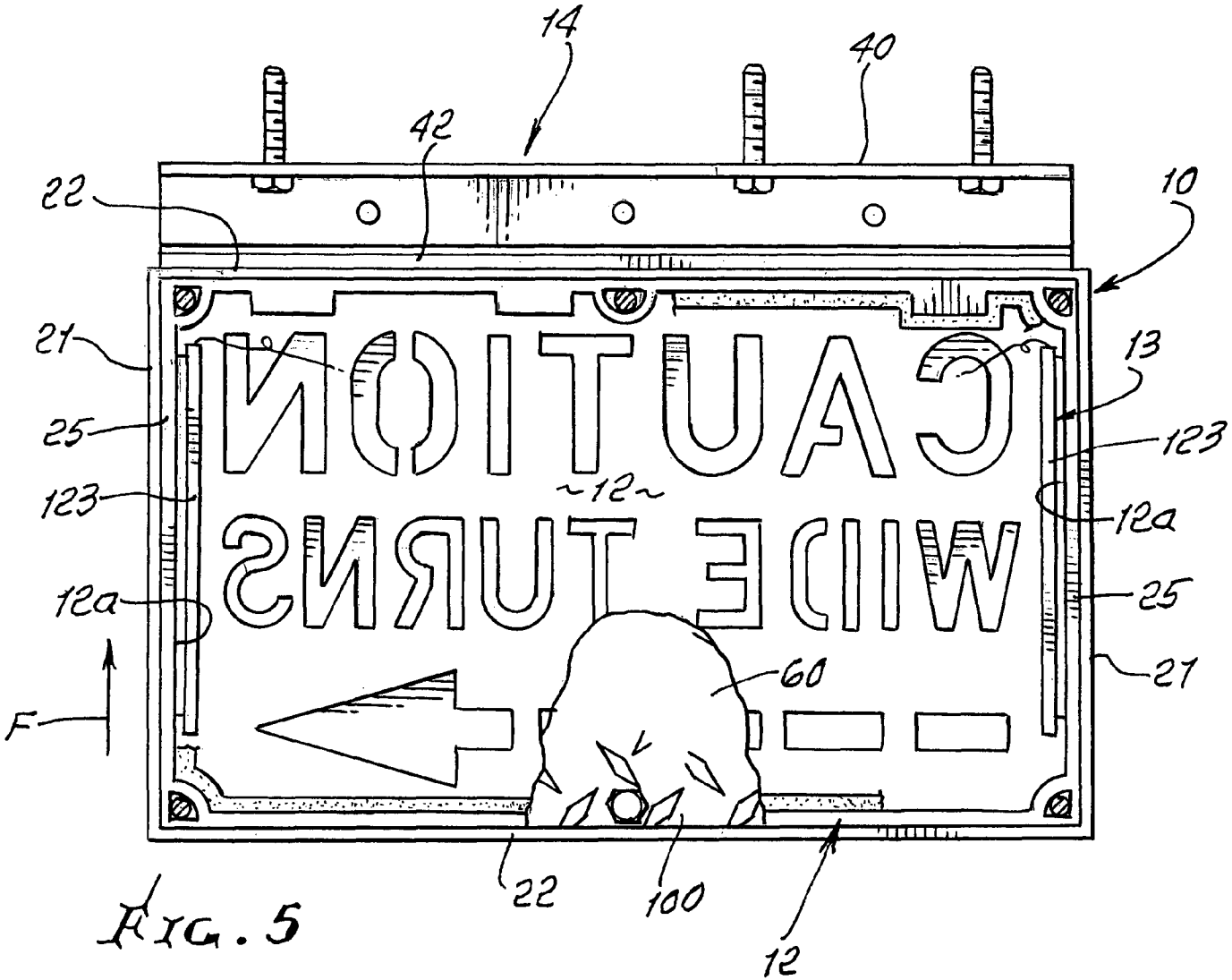
FIG. 5 is a rear elevation taken on lines 5-5 of FIG. 4, and showing box mounting structure.

Also, the metal plate corners may be like the plate area 100 in FIG. 5.

Figure 9:
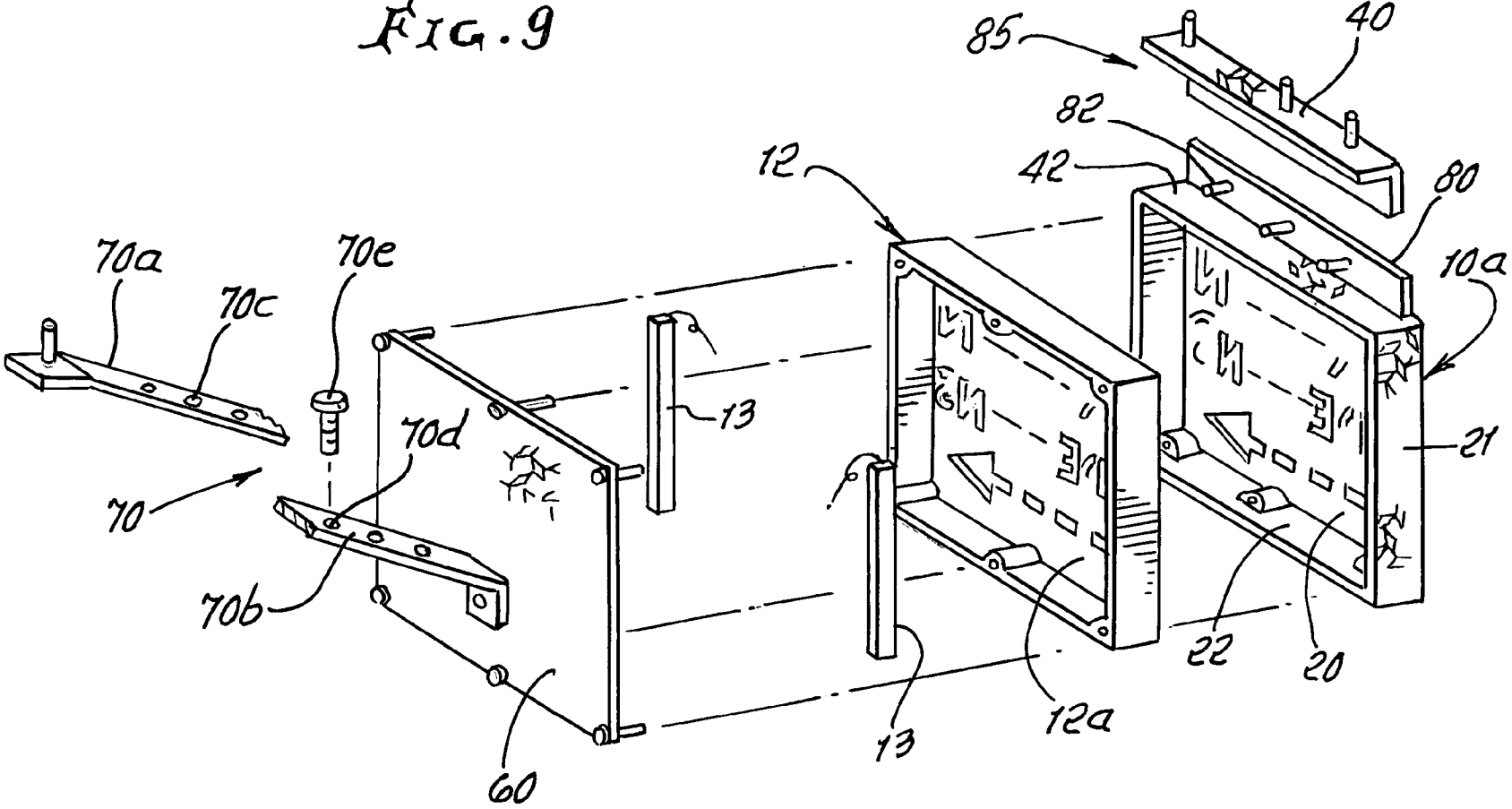
FIG. 9 is like FIG. 8, with modification.

FIG. 9 is like FIG. 8, but shows length adjustability of the safety bar 70. See bar sections 70*a* and 70*b*, overlap to align openings 70*c* and 70*d* in those sections. A fastener 70*e* fits in selected overlapping holes, and is tightenable to firmly connect 70*a* to 70*b*.

See also in FIG. 9, bracket flange 80 upstanding from box top wall 42, for attachment at 82 to L-shaped metal bracket 40. The assembly is indicated at 85.

We claim:

1. An apparatus to communicate a message to a vehicle exterior, comprising a) a sheet metal box having upright panel sides, b) cut-outs in one of said sides configured to communicate a message, said cut-outs having edges defined by and in said box one side, c) colored translucent plastic material defining a plastic panel closely covering and protruding into and through and beyond said cut-outs, and retained proximate said edges, said panel being rectangular and forming a box which nests inside said sheet metal box, d) light means for substantially uniformly illuminating said plastic material, within the box, e) means to connect said sheet metal box to the vehicle whereby said cut-outs face rearwardly of the vehicle, f) said panel box comprising a substantially rectangular frame having walls extending perpendicular to a front surface of the panel box, a first two of said walls extending lengthwise in parallel in a primary direction, and a second two of said walls extending lengthwise in parallel in a secondary direction, and wherein said primary and secondary directions extend relative perpendicularly, said first two walls directing light in said secondary direction into the interior of the frame bounded by said walls, and said second two walls directing light in said primary direction into the interior bounded by the frame, said plastic walls tightly nesting within said sheet metal box, g) said light means including elongated narrow light elements lengthwise adhered to elongated surfaces of certain of said plastic walls that face toward said interior of the frame, h) said light elements having multiple angled surfaces bounding an interior lighting zone to illuminate a box interior zone from multiple directions proximate box sides, i) said cut-outs spaced apart in at least one row in linear sequence in one of said primary and secondary directions, and terminating at endwise locations proximate two of said light elements, respectively.

2. The apparatus of claim 1 wherein said light means is carried at a box interior edge portion to illuminate the entire interior of the box at the same intensity level whereby cut-out illumination is uniform.

3. The apparatus of claim 2 wherein the light means extends lengthwise adjacent the box edge portion extending at approximately 90° to said plastic panel.

4. The apparatus of claim 1 wherein the light means is oriented to direct light parallel to said plastic material in flat sheet form.

5. The apparatus of claim 1 including a vehicle and support member connected to the box to project away from the box, and an elongated carrier strut connected to the support member, and externally connected to said vehicle, said light means frame located between said support member and said cut-outs.

6. The apparatus of claim 5 including a vehicle body rear frame structure that supports said strut so that the box extends vertically, with said cut-outs facing rearwardly.

7. The combination of claim 5 wherein said strut has two sections connected in a length adjustable relation.

8. The apparatus of claim 1 wherein the translucent plastic material of the panel protrudes through cut-outs.

9. The apparatus of claim 8 wherein the plastic panel is sealed to cut-out edges.

10. The apparatus of claim 1 including an electric power line extending from the box exterior to the box interior, via an opening in the box, to supply electrical current supply to said light means.

11. The apparatus of claim 1, wherein all box walls have light reflective metallic inner sides to enhance even light distribution intensity facing the entirety of the plastic translucent material adjacent the cut-outs.

12. The apparatus of claim 1 wherein said plastic material defines a sub-frame nesting tightly within an outer frame defined by the box, and within the cut-outs, the box defining a rear side panel facing edges of said plastic legs.

13. The apparatus of claim 1 wherein the sheet metal box consists of aluminum diamond plate.

14. The apparatus of claim 1 wherein the plastic material is an acrylic plastic.

15. The apparatus of claim 1 wherein the plastic material has one of the following colors: i) amber ii) red iii) yellow and consists of polycarbonate.

16. The apparatus of claim 1 wherein said e) means includes one of the following, attached to a top wall of the box: i) a single bracket ii) two overlapping brackets.

* * * * *